US005168254A

United States Patent [19]

Ito et al.

[11] Patent Number: 5,168,254

[45] Date of Patent: Dec. 1, 1992

[54] MAGNETOSTATIC WAVE DEVICE WITH MINIMIZED HIGHER ORDER MODE EXCITATIONS

[75] Inventors: Kohei Ito, Fukaya; Shigeru Takeda; Yasuhide Murakami, both of Kumagaya; Yasuaki Kinoshita, Hachioji, all of Japan

[73] Assignees: Hitachi Metals, Ltd.; Hitachi, Ltd., both of Tokyo, Japan

[21] Appl. No.: 614,444

[22] Filed: Nov. 16, 1990

[30] Foreign Application Priority Data

Nov. 21, 1989 [JP] Japan ..... 1-300894

[51] Int. Cl.[5] ..... H01P 7/00

[52] U.S. Cl. ..... 333/219.2; 333/202

[58] Field of Search ..... 333/202, 204, 201, 219.2, 333/148

[56] References Cited

U.S. PATENT DOCUMENTS

| | | | |
|---|---|---|---|
| 4,314,214 | 2/1982 | Castera et al. | 333/148 X |
| 4,395,686 | 7/1983 | Adam | 333/148 X |
| 4,465,986 | 8/1984 | Loh et al. | 333/148 |
| 4,743,874 | 5/1988 | Kinoshita et al. | 333/235 X |
| 4,782,312 | 11/1988 | Chang et al. | 333/202 X |
| 4,983,937 | 1/1991 | Kinoshita et al. | 333/202 |
| 4,992,760 | 2/1991 | Takeda et al. | 333/202 X |

FOREIGN PATENT DOCUMENTS

| | | | |
|---|---|---|---|
| 62-245704 | 10/1987 | Japan . | |
| 63-228802 | 9/1988 | Japan . | |
| 233822 | 9/1989 | Japan | 333/219.2 |

*Primary Examiner*—Eugene R. LaRoche
*Assistant Examiner*—Benny Lee
*Attorney, Agent, or Firm*—Finnegan, Henderson, Farabow, Garrett & Dunner

[57] ABSTRACT

A magnetostatic wave device has a nonmagnetic substrate, a magnetic thin film formed on the nonomagnetic substrate, and a plurality of electrodes. By applying a magnetic field from the outside in parallel with or perpendicularly to the magnetic thin film, a magnetostatic wave is excited in the magnetic thin film and is propagated. The magnetostatic wave is coupled with a microwave signal generating circuit by a plurality of (n) electrodes. The plurality which are arranged at positions where the microwave signal is not substantially coupled with the second to (n+1)th order mode of the magnetostatic wave.

16 Claims, 9 Drawing Sheets

MAGNETOSTATIC WAVE DEVICE WITH MINIMIZED HIGHER ORDER MODE EXCITATIONS

BACKGROUND OFF THE INVENTION

The present invention relates to a magnetostatic wave resonator using a principle such that a magnetic spin resonance of a thin magnetic film formed on a nonmagnetic substrate resonates in response to a microwave input signal.

A magnetostatic wave device obtained by working a YIG (yttrium, iron, garnet) thin film which was liquid phase epitaxial grown onto a GGG (gadolinium, gallium, garnet) nonmagnetic substrate into a desired shape has been disclosed in JP-A-62-245704 or the like as a device which is used in a microwave circuit or the like.

FIGS. 4A and 4B are schematic constructional diagrams of a magnetostatic wave device as an example shown in JP-A-62-245704. The magnetostatic wave device is constructed in the following manner. A YIG thin film 2 is formed onto a GGG substrate 1 by a liquid phase epitaxial method. A plurality of electrodes 3 made of gold or aluminum films are formed on the YIG thin film 2 by a photoetching technique so as to be arranged at regular intervals P. Terminals 4 (see FIG. 4B) made of gold or aluminum films are also formed on both sides of the electrodes 3 on the YIG thin film 2 by the photoetching technique. The magnetostatic wave device is connected at the terminals 4 to a part of a microwave circuit.

When a magnetic field $H_o$ is applied to the above magnetostatic wave device in parallel with or perpendicularly to the YIG film surface by either one of or both of a magnet and a coil (not shown), a resonance based on an electronic spin resonant phenomenon occurs. For instance, when an external magnetic field $H_o$ is applied as a perpendicular magnetic field onto the film surface of the magnetostatic wave device in FIGS. 4A, 4B, a magnetostatic forward volume wave is propagated in the YIG thin film and is reflected by both edge surfaces 5*a* and 5*b* of the YIG thin film and thereby becomes a standing wave, to produce resonance. The frequency at which resonance occurs can be changed by changing the magnetic field. A microwave oscillator can be manufactured by using such a magnetostatic wave device as a two-terminal device. It is well known that the magnetostatic wave device has excellent features such that it has a high degree of selection (Q) due to the YIG thin film being of a high quality, and a large variable width of the resonance frequency can be obtained, and the like.

A fact that the above device is relatively cheap because it is formed by the photoetching technique as also comparing with a device using a YIG sphere which has already widely been used in a microwave region is disclosed in JP-A-62-228802.

In FIGS. 4A and 4B, the positions of the electrodes 3 are shown at a pitch P of regular intervals. On the other hand, FIG. 5 shows positions of the electrodes in U.S. Pat. Ser. No. 4,782,312 as another conventional technique. FIG. 5 shows the case of a device having a length W and a width 1, where an input electrode 6*a* and an output electrode 6*b* are arranged at the peak positions of a Jth order resonance mode.

In FIG. 6A, J indicates a mode of a magnetostatic wave which stands in the width (i) direction of the electrode of the magnetostatic wave device. In this case, if the input electrode 6*a* and the output electrode 6*b* individually exist as shown in FIG. 5, the peak position in the lowest order resonance mode is J=2. Such a state corresponds to the positions of a and b in FIG. 6A. In the case of arranging a single electrode without separating the input and output electrodes, a position c corresponding to J=1 in the lowest order resonance mode is set.

However, in the above conventional technique, as shown in FIG. 6A, since high order modes other than the magnetostatic wave mode for coupling exist, a spurious resonance occurs due to the high order modes. For instance, in the case of constructing a microwave oscillator using such a resonator, there is a phenomenon such that an oscillation occurs at an undesirable frequency. Although an output of the main resonance is high even at the electrode positions in FIG. 5, the spurious resonance cannot be suppressed. Therefore, there is a problem such that an output of the undesirable frequency still remains.

SUMMARY OF THE INVENTION

It is an object of the invention to provide a magnetostatic wave device which can solve the conventional drawbacks and in which the resonance by the high order modes is suppressed and the spurious resonance is small in consideration of the above problems.

To accomplish the above object, a magnetostatic wave device of the present invention comprises: a nonmagnetic substrate; a ferrimagnetic thin film which is formed on the nonmagnetic substrate and to which a magnetic field is applied in parallel with or perpendicularly to the film surface; and a plurality of electrodes for coupling a microwave with a magnetostatic wave in the ferrimagnetic thin film surface. In the magnetostatic device of the invention, the electrodes are arranged at positions where the microwave is not coupled with the modes from the second mode to the (n+1)th order mode among the modes of the magnetostatic wave, where n is the number of electrodes.

On the other hand, in the magnetostatic wave device, when it is now assumed that the number of electrodes is set to n, the distance between the reflecting edge surfaces of the magnetostatic wave is set to l, and the distance from one of the magnetostatic wave reflecting edge surfaces to the ith electrode is set to $X_i$, there is provided a magnetostatic wave device in which the electrodes are arranged at the positions which substantially satisfy the following relation of the equation (i).

$$\sum_{i=1}^{n} \sin(J\pi X_i/l) = 0 \qquad \text{(i)}$$

(J is set so as to satisfy all of J=2, 3, . . . , n+1)

Further, in the magnetostatic wave device, a plurality of electrodes are formed and when it is now assumed that the number of electrodes is set to n, the distance between the magnetostatic wave reflection edge surfaces is set to l, and the distance from one of the magnetostatic wave reflection edge surfaces to the ith electrode is set to $X_i$, there is provided a magnetostatic wave device in which the electrodes are arranged symmetrically with respect to the center between the magnetostatic wave reflection edge surfaces and are arranged at positions which substantially satisfy the following relation of the equation (ii).

$$\sum_{i=1}^{n} \sin(J\pi X_i/l) = 0 \quad \text{(ii)}$$

(J is set so as to satisfy all of J=3, 5, . . . , n−1, n+1)

On the other hand, further, in a magnetostatic wave device comprising a ferrimagnetic thin film and one or a plurality of electrodes for coupling a microwave with a magnetostatic wave in the ferrimagnetic thin film surface, when assuming that a distance from one of the magnetostatic wave reflection edge surfaces to the ith electrode is set to $Y_i$, there is provided a magnetostatic wave device in which the electrodes are arranged symmetrically with respect to the center of the magnetostatic wave reflection edge surfaces and both edges in the width direction of the electrodes occupy the positions $Y_i$ which substantially satisfy the following relation of the equation (iii).

$$\sum_{i=1}^{2n} \sin(J\pi Y_i/l) = 0 \quad \text{(iii)}$$

(J is set so as to satisfy all of J=3, 5, . . . , 2n−1, 2n+1)

The present inventors have found out that the coupling intensity between a microwave current flowing through the electrode and each high order mode of the magnetostatic wave is almost proportional to the amplitude of each high order mode of the magnetostatic wave at the relevant position. Further, it has also been found that in order to prevent microwave current from being coupled with the high order mode of the magnetostatic wave, it is desirable to apply no energy from each electrode to each high order mode and to arrange the electrodes at positions such that no energy is detected.

A position obtained by integrating the amplitude at the electrode position by each high order mode is set to the position of 0 (zero). At such a position, it is presumed that a certain electrode is coupled with the high order mode and even if it couples by only an amount of a +(positive) amplitude, another electrode is coupled with the high order mode by only the same amount of a −(minus) amplitude, so that the coupling intensities for all of the electrodes are set off and eventually become 0 (zero).

On the other hand, the present inventors also have found on the basis of the above relations that if n electrodes are arranged at positions near the positions which satisfy the equation (i), the coupling intensities with the high order modes until the (n+1)th mode can be reduced and the spurious resonance can be minimized.

Since a degree of freedom at the positions of n electrodes is equal to n, in the case of n electrodes, it is possible to effectively compensate for the high order modes from the second to (n+1)th orders.

For instance, in the case of suppressing spurious resonances up to the third mode (J=3) by using two electrodes, the equation (i) can be developed as follows.

$$\sum_{i=1}^{2} \sin(J\pi X_i/l) = 0$$

$$(J = 2, 3)$$

It is sufficient to simultaneously satisfy the equations (1-1) and (1-2).

$$\sin(2\pi X1/l)+\sin(2\pi X2/l)=0 \quad \text{(1-1)}$$

$$\sin(3\pi X1/l)+\sin(3\pi X2/l)=0 \quad \text{(1-2)}$$

The right side of the equation (1-1) denotes a coupling degree with the second mode. Assuming that $X_i$ indicates a distance from one of the magnetostatic wave reflection edge surfaces, the second mode is expressed by $\sin(2\pi X_i/l)$ as shown in a curve of J=2 in FIG. 6B.

Although there are numberless solutions of the equation (i), for instance, assuming that the position of $X_i$ is set to d, the value of $\sin(2\pi X_1/l)$ is equal to $-S_2$, that is, the value of the amplitude at that position. To prevent the microwave from becoming substantially coupled by the insection of another, additional electrode, it is sufficient to arrange the electrode at a position having an amplitude of $\sin(2\pi X_2/l)=S_2$, that is, a symmetrical position d' with respect to an intermediate point c in FIG. 6B as a center. In FIG. 6B, the terms a, b, c, and J to be construed in the same manner as discussed previously in relation to FIG. 6A.

This means that even when one of the electrodes is arranged at any position, if it is arranged symmetrically with respect to the intermediate point c, the microwave is not substantially coupled with the second mode.

On the other hand, the right side of the equation (1-2) indicates a coupling degree with the third mode. Similarly, now assuming that $X_i$ denotes a distance from one of the magnetostatic wave reflection edge surfaces, the third mode is expressed by $\sin(3\pi X_i/l)$ as shown in a curve of J=3 in FIG. 6B.

In the above case, for instance, by arranging the electrode symmetrically with respect to the intermediate point c as mentioned above so as to satisfy the equation (1-1), it will be easily understood by the calculations that positions of $e_1$ and $e_2$ exist as positions where the microwave is not substantially coupled with the third mode as well.

That is, the positions $e_1$ and $e_2$ satisfy the equation (i) and indicate the positions of the electrodes in the invention.

On the other one hand, since the even-number designated order mode is expressed by an odd function for a center line including the center between the magnetostatic wave reflection edge surfaces on the magnetostatic wave device, by arranging an even number of electrodes at positions which are symmetrical with respect to the center line and are close to the position $X_i$ which satisfies the relation of the equation (ii), the couplings between all of the even-number designated high order modes and the odd-number designated high order modes until the (n+1)th order can be suppressed and effectively reduces, the spurious resonances.

On the other hand, since a microwave current flowing through the electrode has a distribution such that a large amount of microwave current flows at both ends of the electrode and a small amount of current flows at a position near the center, assuming that a distance from one of the magnetostatic wave reflection edge surfaces is set to $Y_i$, the high order modes can be suppressed by arranging the electrodes in a manner such that both ends in the width direction of each of the electrodes occupy the positions near the position $Y_i$ which is symmetrical with respect to the center line and satisfies the relation of the equation (iii).

According to the magnetostatic wave device of the invention, it will be understood that spurious resonance is suppressed in a mode near the first mode among the high order modes as compared with the conventional example. Thus, the magnetostatic wave device of the invention is effective for use in a microwave oscillator, a filter, or the like and miniaturization and a high degree of integration density can be accomplished. Further, a magnetostatic wave, device results in a resonance frequency which can be easily controlled.

DESCRIPTION OF THE PREFERRED EMBODIMENTS

Magnetostatic wave devices of the invention will be described with reference to the drawings. However, the invention is not limited to those embodiments.

Embodiment 1

Figure 1:
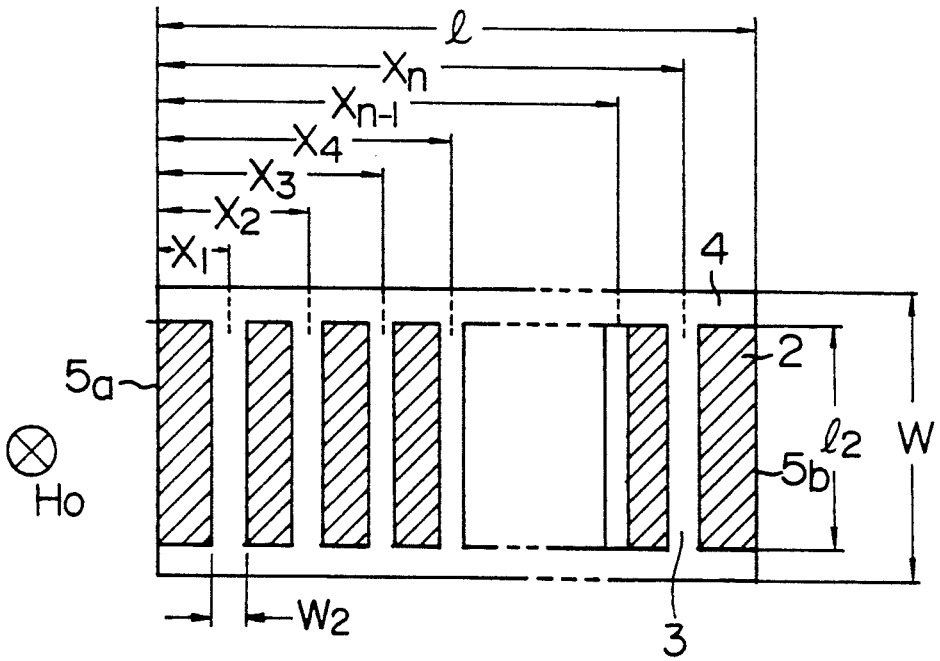
FIG. 1 is a plan view showing an embodiment of a magnetostatic wave device according to the invention.
Figure 4A:
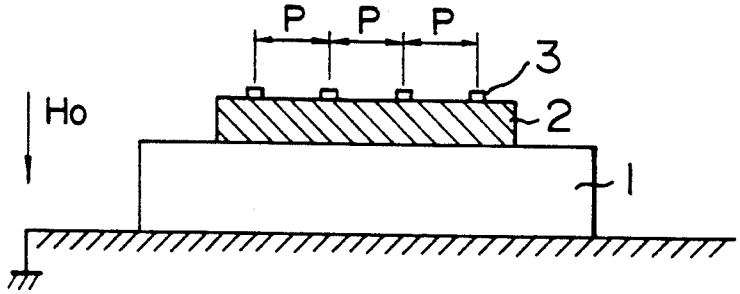
FIG. 4A (PRIOR ART)
FIG. 4A is a side elevational view of a conventional magnetostatic wave device.
Figure 4B:
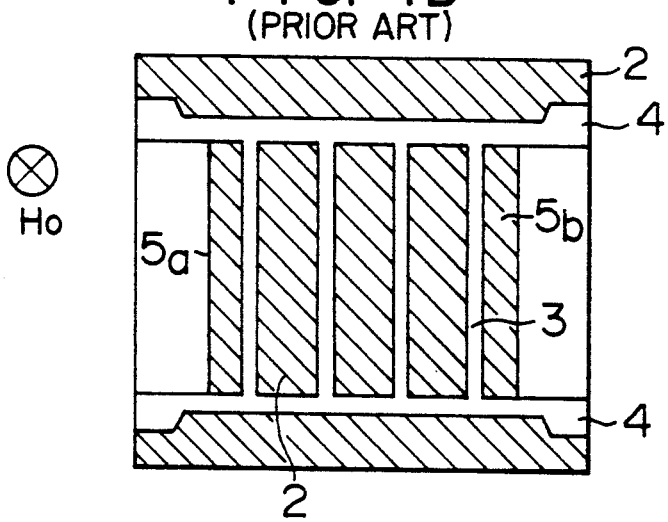
FIG. 4B (PRIOR ART)
FIG. 4B is a plan view of the conventional magnetostatic wave device shown in FIG. 4A.
Figure 5:
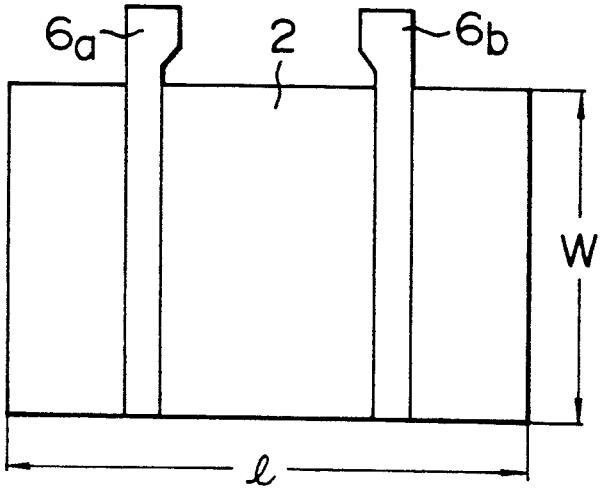
FIG. 5 (PRIOR ART)
FIG. 5 is a plan view of another conventional magnetostatic wave device.
Figure 6A:
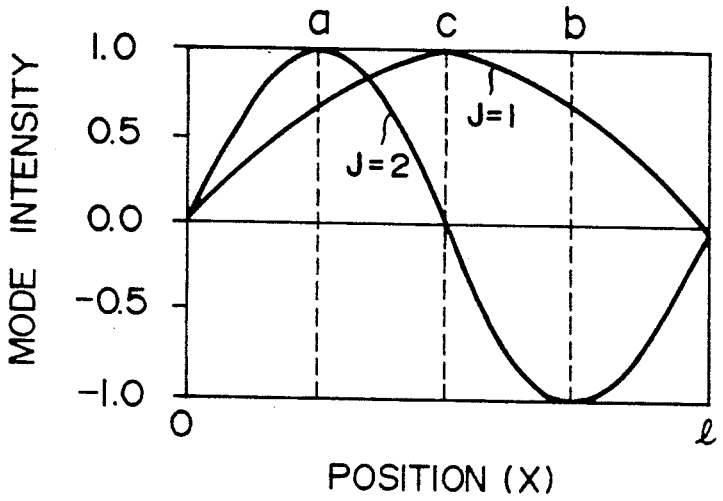
FIG. 6A (PRIOR ART)
FIG. 6A is a diagram for explaining the relations between the arrangements of electrodes and the mode intensities in the conventional magnetostatic wave devices.
Figure 6B:
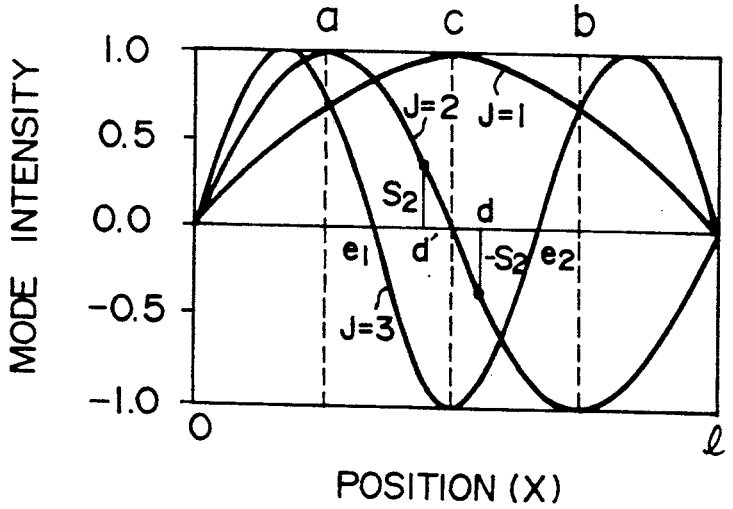
FIG. 6B is a diagram for explaining the relations between the arrangements of electrodes and the mode intensities in the magnetostatic wave devices of the invention.
Figure 7:
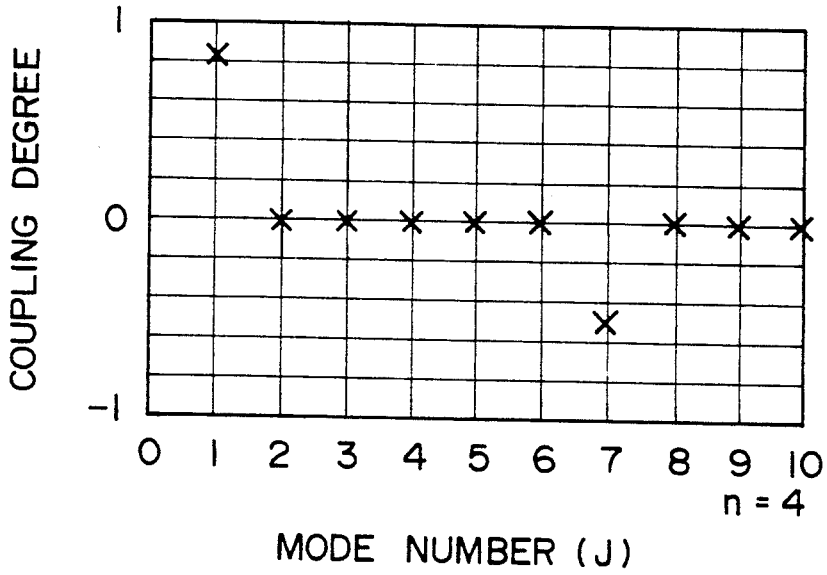
FIG. 7 is a diagram showing the relations of the coupling degrees to the mode numbers in a first variation of a first embodiment (sample No. 1; 4 electrodes)
Figure 8:
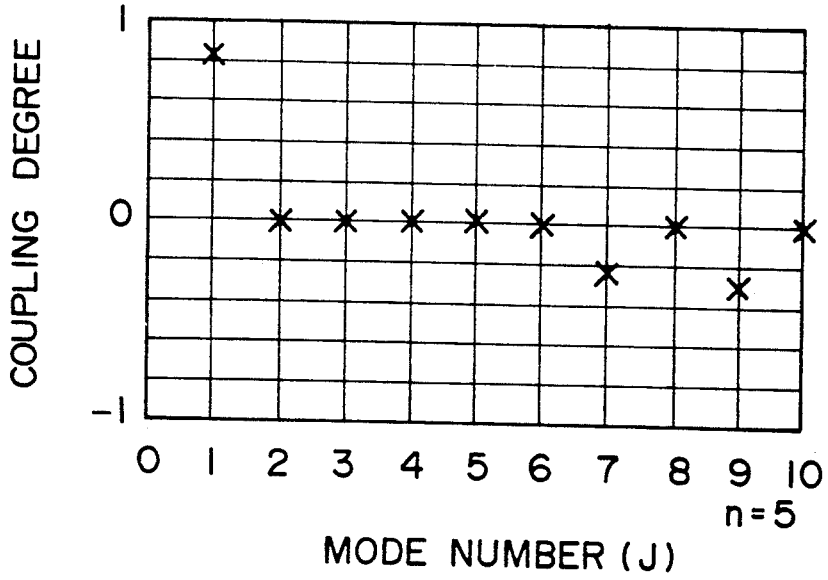
FIG. 8 is a diagram showing the relations of the coupling degrees to the mode numbers in a second variation of the embodiment (sample No. 2; 5 electrodes)
Figure 9:
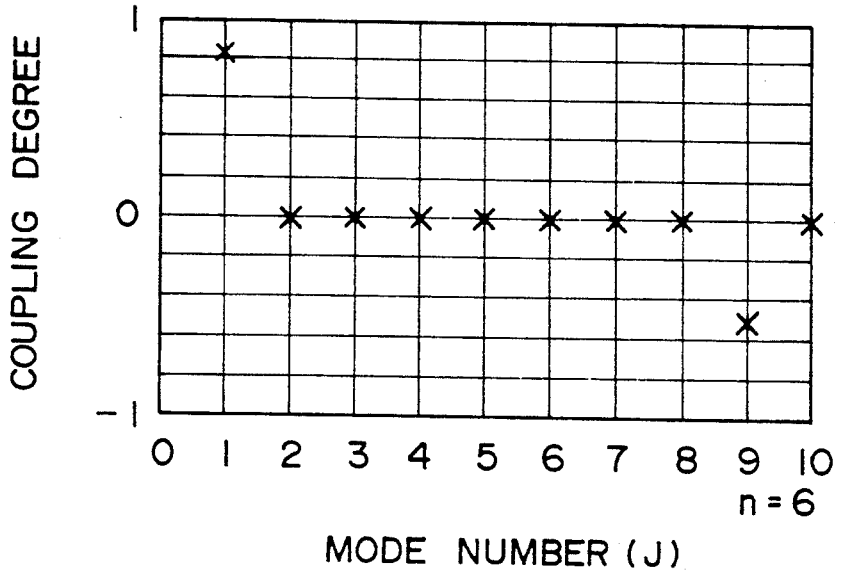
FIG. 9 is a diagram showing the relations of the coupling degrees to the mode numbers in a third variation of the embodiment (sample No. 3; 6 electrodes)
Figure 10:
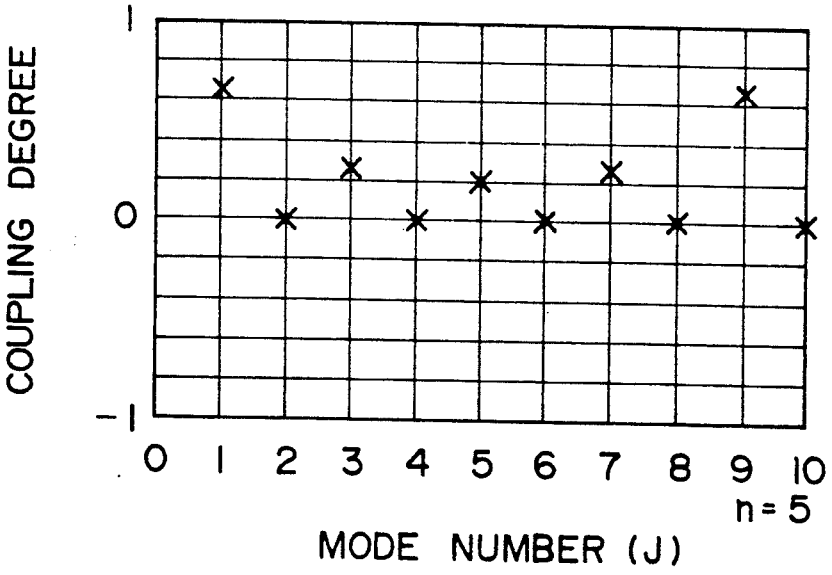
FIG. 10 is a diagram showing the relations of the coupling degree to the mode numbers in the conventional example (sample No. 4; 5 electrodes)

FIG. 1 is a plan view of a magnetostatic wave device showing an embodiment of the invention. Similarly to the well-known magnetostatic wave device shown in FIG. 4, the magnetostatic wave device of the embodiment 1 is constructed in the following manner. The YIG thin film 2 is formed onto a GGG substrate (not shown in FIG. 1) by the liquid phase epitaxial growing method. n electrodes 3 made of gold or aluminum films are formed onto the YIG thin film 2 by the photoetching technique. The terminals 4 which are made of gold or aluminum films and are connected to both sides of the electrodes 3 are also formed onto the YIG thin film 2 by the photoetching technique. The magnetostatic wave device is connected to a microwave circuit at the terminals 4.

As practical dimensions of the magnetostatic wave device, for instance, a width l of the YIG thin film was set to 2 mm, a length W thereof was set to 5 mm, a length $l_2$ of the coupling electrode 3 was set to 3 mm, a width $W_2$ thereof was set to 0.02 mm, and a thickness of the YIG thin film 2 was set to 35 μm.

The number n of electrodes is changed and the central positions of the electrodes are set to $X_i$. Then, the electrode positions $X_i$ which satisfy the relation of $$\sum_{i=1}^{n} \sin(J\pi X_i/l) = 0 \qquad \text{(i)}$$

$$(J = 2, 3, \ldots, n, n+1)$$

were obtained and the electrodes were formed at the electrode positions $X_i$ shown in Table 1.

TABLE 1

| | Embodiment 1 | | | Comparison example |
|---|---|---|---|---|
| Sample No. | 1 | 2 | 3 | 4 |
| The number n of electrodes | 4 | 5 | 6 | 5 |
| Position mm | | | | |
| X1 | 0.47 | 0.42 | 0.38 | 0.20 |
| X2 | 0.87 | 0.76 | 0.70 | 0.60 |
| X3 | 1.13 | 1.00 | 0.87 | 1.00 |
| X4 | 1.53 | 1.24 | 1.13 | 1.40 |
| X5 | — | 1.58 | 1.30 | 1.80 |
| X6 | — | — | 1.62 | — |

Table 1 also shows the arranging positions of the electrodes in the case where the electrodes were arranged at regular intervals as a comparison example.

The electrodes were arranged at the positions which are symmetrical with respect to the center of the width ( of the YIG thin film 2.

FIGS. 7, 8, 9, and 10 respectively show the results of the calculations of the coupling degrees (shown by x in the diagrams) for the three variations of the first embodiment of the present invention (sample Nos. 1, 2, 3) and the comparison example (sample No. 4) shown in Table 1 when it is assumed that the calculated value of the right side of the equation (i) is set to a coupling degree and the mode (J) of the magnetostatic wave is set to J=1, 2, 3, . . . , n, n+1, . . . , 10.

From the above diagrams, in the embodiments of the present invention, it can be presumed that the microwave is not coupled with the high order modes J=2 to n+1 such that no significant resonances appear for J=n+1 other than the main resonance of J=1. In the diagrams, "x" indicates a coupling state. In the embodiment, in the case of the example having an even number of electrodes, it will be presumed from FIGS. 7 and 9 that the microwave is not coupled until the n+2)th order mode. The electrode positions in the case where the number of electrodes is an even number satisfy the above equation (ii).

On the other hand, in the comparison example, it can be presumed that the microwave is coupled with the modes close to the main resonances of J=3 and J=5 in addition to the main resonance J=1.

To verify the above presumption, the following experiments were executed with respect to the above magnetostatic wave devices. A magnetic field $H_o$ of about 2500 Oe was applied perpendicularly to the YIG film surface 2 of the magnetostatic wave device (such a perpendicular direction is shown by ⊗ in FIGS. 1, 2 and 4B, with the direction of the magnetic field being directed the diagram) and the band blocking characteristics were measured by a network analyzer. FIGS. 11 to 14 show the results of the measurements with respect to the sample Nos. 1 to 4, respectively. The ordinates axis indicates gain and the abscissa axis represents a frequency.

From the above results, all of the main resonances of the magnetostatic wave device of the embodiment are located near 2.2 GHz and it will be presumed that the resonance occurs at a frequency, namely, in the first mode in which a propagation length is equal to ½ of the wavelength.

Figure 13:
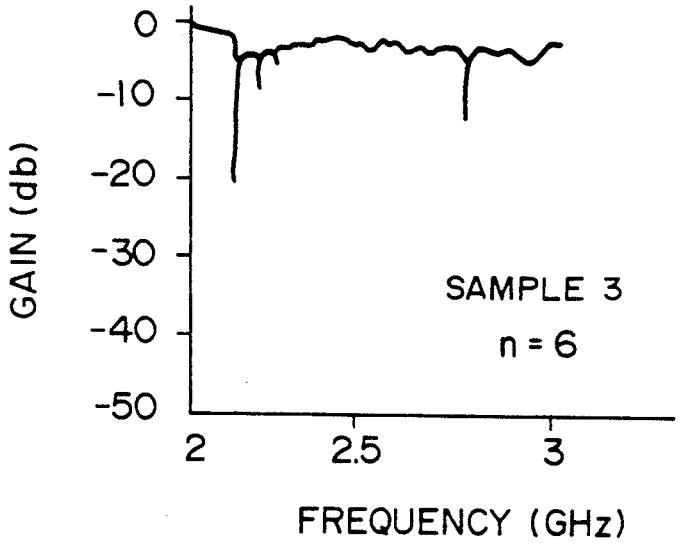
FIG. 13 is a diagram showing the band blocking characteristics in the third variation (sample No. 3; 6 electrodes)
Figure 14:
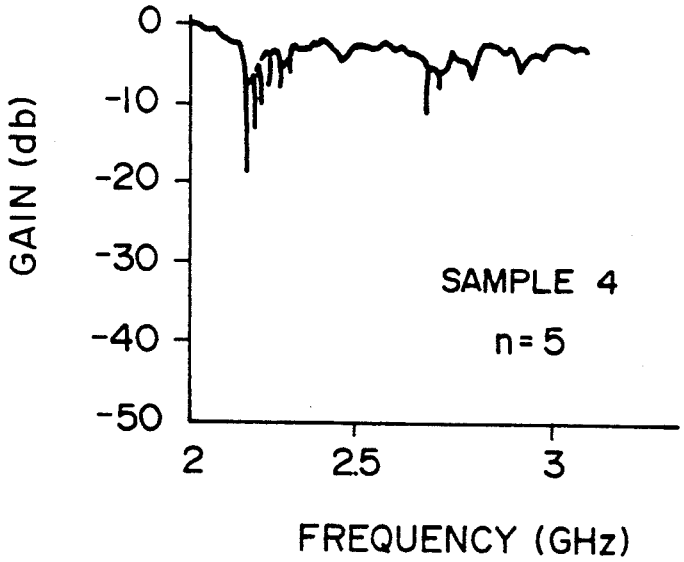
FIG. 14 is a diagram showing the band blocking characteristics in the conventional example (sample No. 4; 5 electrodes)

According to the band blocking characteristics of the embodiments (FIGS. 11, 12, 13), it has been confirmed that the spurious resonance was suppressed in the higher order spurious resonance modes close to the main resonance mode as compared with the comparison example (FIG. 14). On the other hand, according to the comparison example, such higher made spurious resonance cannot be suppressed, so that an undesirable output still exists at a frequency close to the main resonance.

Figure 11:
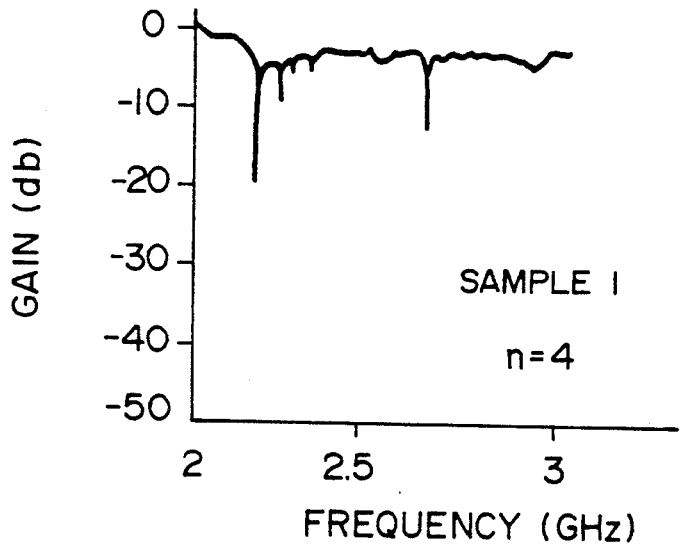
FIG. 11 is a diagram showing the band blocking characteristics in the first variation (sample No. 1; 4 electrodes)

When considering FIGS. 11 and 13, large spurious resonances exist at frequencies close to 2.6 GHz and 2.8 GHz. Although these frequencies are away from the main resonance, it will be understood from FIGS. 11 and 13 that it is desirable to increase the number n of electrodes from a viewpoint of the band characteristics.

Figure 12:
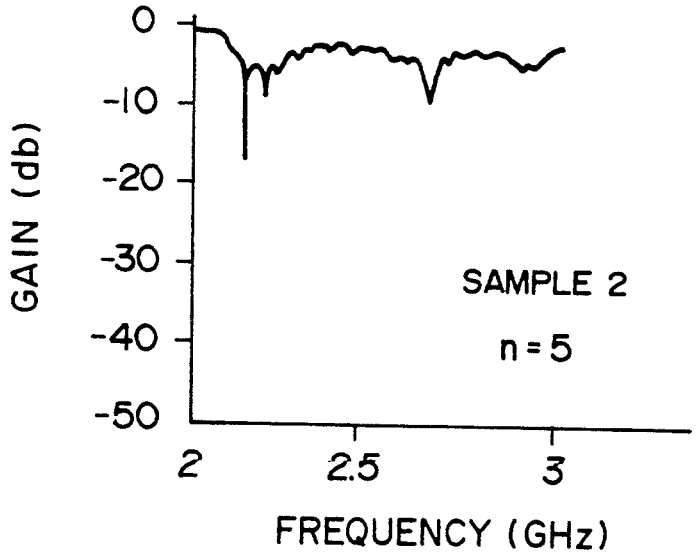
FIG. 12 is a diagram showing the band blocking characteristics in the second variation (sample No. 2; 5 electrodes)

On the other hand, when comparing FIGS. 11 and 12, large spurious resonances exist at the same position (near 2.6 GHz) in both of the cases. It will be understood that even in the case where the number of electrodes is smaller by one electrode, the similar band characteristics are derived by arranging an even number of electrodes at the positions which are symmetrical with respect to the center of the width l of the YIG thin film 2 as in the case of the sample No. 1.

In accordance with the present invention it is sufficient that the electrode positions substantially satisfy the relation of the equation (i). As an extent of the electrode position, if it lies within a value of about ¼ of the wavelength in the high order mode to be considered, the effect of the suppression can be substantially expected.

On the other hand, there has been shown the case where the magnetic field of an about 2500 Oe was applied perpendicularly to the YIG film surface 2 of the magnetostatic wave device. However, the resonance frequency can be also obviously changed by variably setting the magnetic field. It will be also easily presumed that an almost similar result will be derived even if the magnetic field is applied in parallel with the YIG film surface 2.

Embodiment 2

Figure 2:
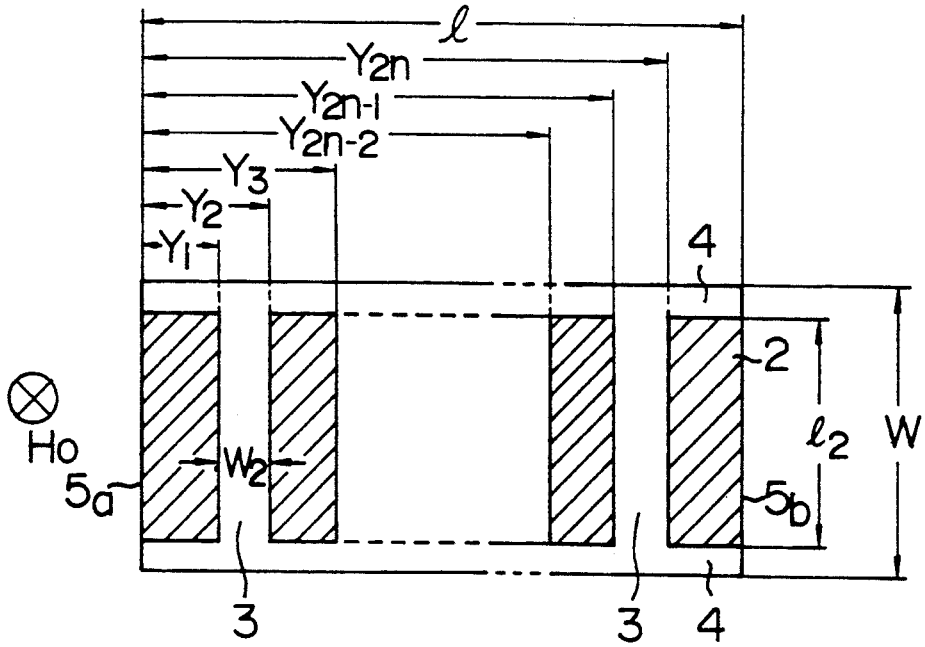
FIG. 2 is a plan view showing another embodiment of the magnetostatic wave device of the invention.

FIG. 2 is a plan view of the magnetostatic wave device showing another embodiment of the invention. The magnetostatic wave device was formed by the same manufacturing method as that shown in FIG. 1.

Practically speaking, for instance, the number n of electrodes was set to two, a width 1 of the YIG thin film 2 was set to 2 mm, a length W thereof was set to 5 mm, a length $l_2$ of the coupling electrode 3 was set to 3 mm, and a thickness of the YIG thin film 2 was set to 35 μm.

The positions of the edges in the width direction of the two electrodes respectively, are assumed to be $Y_1$, $Y_2$, $Y_3$, and $Y_4$ and it is assumed that the electrodes are arranged symmetrically with respect to the center of the width direction of the YIG thin film 2. In the above conditions, the positions which satisfy the equation (iii) were obtained as follows.

By substituting the number of electrodes n=2 for the equation (iii) and developing, we have $$\sum_{i=1}^{4} \sin(3\pi Y_i/l) = 0 \qquad \text{(IV)}$$

$$\sum_{i=1}^{4} \sin(5\pi Y_i/l) = 0 \qquad \text{(V)}$$

The positions $Y_1$, $Y_2$, $Y_3$, and $Y_4$ which satisfy both of the equations (IV) and (V) were obtained. The results of the calculations are shown in Table 2.

TABLE 2

| | Embodiment 2 |
|---|---|
| Sample No. | 5 |
| The number n of electrodes | 2 |
| Position mm | |
| Y1 | 0.47 |
| Y2 | 0.87 |
| Y3 | 1.13 |
| Y4 | 1.53 |

The band blocking characteristics of the above magnetostatic wave device were measured under the same conditions as those in the embodiment 1. Thus, the results similar to those in the case where four electrodes were arranged in the embodiment 1 (FIG. 11) were obtained. It has been confirmed that there is an effect to suppress the high order modes.

Therefore, even in the case of the electrode positions which satisfy the equation (iii), it has been confirmed that there is a suppression of resonances corresponding to the high order modes.

Embodiment 3

Figure 3A:
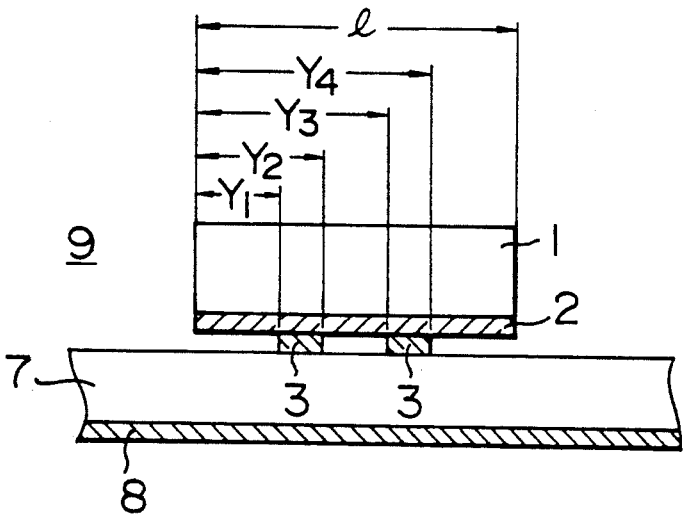
FIG. 3A is a side elevational view of the third embodiment of the magnetostatic wave device of the invention.
Figure 3B:
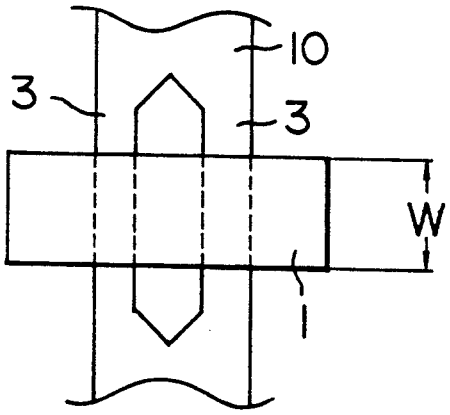
FIG. 3B is a plan view of the magnetostatic wave device shown in FIG. 3A.

FIGS. 3A and 3B show a side elevational view and a plan view of the magnetostatic wave device in the third embodiment.

The third embodiment relates to the case of using a micro strip line 9 as the electrodes 3. The micro strip line 9 comprises an upper surface conductor 10 (see FIG. 3B) and a back surface conductor 8 (see FIG. 3A) so as to sandwich a dielectric material 7. Two electrodes 3 were formed perpendicularly to the longitudinal direction of the micro strip line 9 as shown in FIG. 3B. The GGG substrate 1 was formed perpendicularly to the longitudinal direction of the micro strip line 9, while setting the surface of the YIG thin film 2 onto the side of the electrodes 3, thereby forming the magnetostatic wave device. The edges of the YIG thin film 2 and the positions $Y_1$ to $Y_4$ of the electrodes 3 were set as shown in the results of Table 2 in accordance with the embodiment 2.

Practically speaking, for instance, a width l of the YIG thin film 2 was set to 2 mm, a length W thereof was set to 5 mm, and a thickness of the YIG thin film 2 was set to 35 μm.

The band blocking characteristics of the magnetostatic wave device of the embodiment 3 were measured in a manner similar to the embodiment 2. Thus, almost the same results as those in the embodiment 2 were obtained.

In the present invention, the positions of plural electrodes are defined. The tolerances of the positions are approximately $\frac{1}{8}$ of the mode wavelengths λ. In case of n electrodes and (n+1)th order harmonic mode, the tolerance value is approximately $2l/n+1\times\frac{1}{8}=l/4(n+1)$ wherein l is the length of the resonator.

Figure 15:
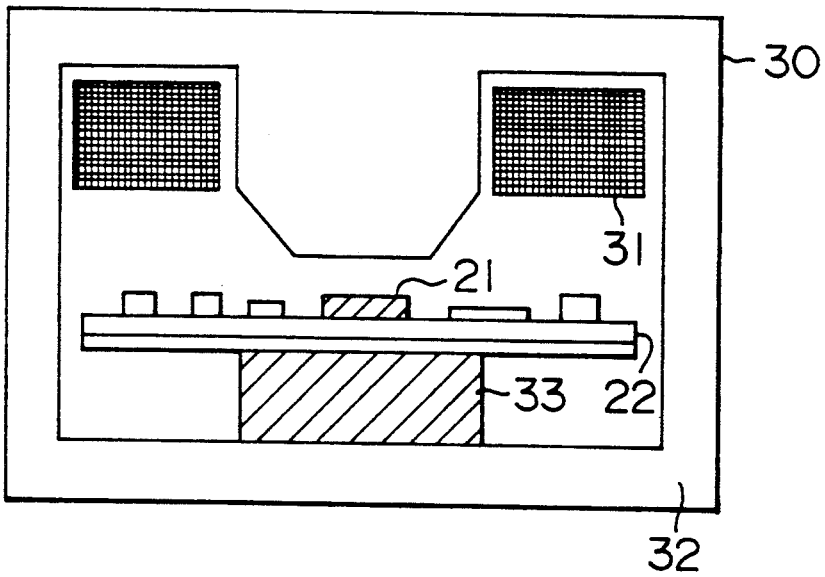
FIG. 15 shows an example of a magnetostatic wave apparatus made in accordance with the present invention.

The magnetostatic wave device of the invention is assembled into a magnetostatic wave apparatus together with a magnetic field applying apparatus and used. FIG. 15 shows an example of a magnetostatic wave apparatus. In the magnetostatic wave apparatus of FIG. 15, a magnetostatic wave device 21 is provided on a dielectric material plate 22 and is installed in a magnetic field applying apparatus 30 comprising a driving coil 31, a yoke 32, and a permanent magnet 33.

We claim:

1. A magnetostatic wave device to which can be applied a bias magnetic field and which is operatively connectable to a microwave signal generating circuit, the device comprising:

a nonmagnetic substrate with a surface;

a magnetic thin film disposed on the surface of the nonmagnetic substrate, for having excited therein and propagating a magnetostatic wave in accordance with the applied bias magnetic field, said magnetostatic wave having a first order mode and second to (n+1)th order modes;

a pair of terminals coupled to the magnetostatic wave device for connecting to the microwave signal generating circuit; and a plurality of electrodes, operatively connected between said terminals and disposed on the magnetic thin film, for coupling a microwave signal provided from the generating circuit to excite the magnetostatic wave in the magnetic thin film, wherein said plurality of electrodes are arranged at positions on the magnetic film where the microwave signal is not substantially coupled to excite the second to (n+1)th order modes of the magnetostatic wave, said electrodes being arranged to minimize the net total of the excitations for each of the second through the (n+1)th order modes.

2. The device according to claim 1, wherein the bias magnetic field is applied perpendicularly to the surface where said thin film is disposed.

3. The device according to claim 1, wherein the bias magnetic field is applied in parallel with the surface where said thin film is disposed.

4. A magnetostatic wave device to which can be applied a bias magnetic field and which is operatively connectable to a microwave signal generating circuit, the device comprising:

a nonmagnetic substrate with a surface;

a magnetic thin film, disposed on the surface of the nonmagnetic substrate, for having excited therein and propagating a magnetostatic wave in accordance with the applied bias magnetic field, said magnetostatic wave having a first order mode and second to (n+1)th order modes, said device having a pair of opposed means operatively connected to said film for reflection of the magnetostatic wave in said film;

a pair of terminals coupled to the magnetostatic wave device for connecting to the microwave generating circuit; and a plurality of electrodes, operatively connected between said terminals and disposed on the magnetic thin film, for coupling a microwave signal provided from the generating circuit to excite the magnetostatic wave in the magnetic thin film, wherein said plurality of electrodes are arranged at positions on the magnetic film which substantially satisfy the following equation:

$$\sum_{i=1}^{n} \sin(J\pi X_i/l) = 0$$

with respect to all of the value of J (=2, 3, . . . , n+1), where, i: the summing index n: the number of said plurality of electrodes, l: distance between the ones of said pair of opposed reflection means, $X_i$: distance from one of the pair of opposed reflection means to the ith electrode.

5. The device according to claim 4, wherein said thin film includes opposed edge surfaces, and the pair of opposed reflection means are comprised by said opposed edge surfaces of the magnetic thin film.

6. The device according to claim 4, wherein the electrodes are a part of a micro strip line.

7. The device according to claim 4, wherein the bias magnetic field is applied perpendicularly to the surface where said thin film is disposed.

8. The device according to claim 4, wherein the bias magnetic field is applied in parallel with the surface where said thin film is disposed.

9. A magnetostatic wave device to which can be applied a bias magnetic field and which is operatively connectable to a microwave signal generating circuit, the device comprising:

a nonmagnetic substrate having a surface;

a magnetic thin film, disposed on the surface of the nonmagnetic substrate, for having excited therein and propagating a magnetostatic wave in accordance with the applied bias magnetic field, said magnetostatic wave having a first order mode and second to (n+1)th order modes, said device having a pair of opposed means operatively connected to said film for reflection of the magnetostatic wave in said film;

a pair of terminals coupled to the magnetostatic wave device for connecting to the microwave signal generating circuit; and an even numbered plurality of electrodes, operatively connected between said terminals and disposed on the magnetic thin film, for coupling a microwave signal provided from the generating circuit to excite the magnetostatic wave in the magnetic thin film, wherein said plurality of electrodes are arranged symmetrically with respect to a point midway between the ones of said pair of opposed reflection means of the magnetostatic wave and the respective electrodes are arranged at positions on the magnetic film which substantially satisfy the following equation:

$$\sum_{i=1}^{n} \sin(J\pi X_i/l) = 0$$

with respect to all of the value of J (=3, 5, . . . , n−1, n+1), where i: the summing index n: the even number of said plurality of electrodes, l: distance between the ones of said pair of opposed reflection means, $X_i$: distance from one of the pair of opposed reflection means to the ith electrode.

10. The device according to claim 9 wherein said thin film includes opposed edge surfaces, and the reflection means are comprised by said opposed edge surfaces of the magnetic thin film.

11. The device according to claim 9, wherein the electrodes are a part of a micro strip line.

12. The device according to claim 9, wherein the bias magnetic field is applied in parallel with the surface where said thin film is disposed.

13. The device according to claim 9, wherein the bias magnetic field is applied perpendicularly to the surface where said thin film is disposed.

14. A magnetostatic wave apparatus operatively connectable to a microwave signal generating circuit, the apparatus comprising:

bias magnetic field applying means for applying a bias magnetic field;

a nonmagnetic substrate with a surface;

a magnetic thin film, disposed on the surface of the nonmagnetic substrate, for having excited therein and propagating a magnetostatic wave in accordance with the bias magnetic field, said magnetostatic wave having a first order mode and second to (n+1)th order modes;

a pair of terminals coupled to the magnetostatic wave apparatus for connecting to the microwave signal generating circuit; and a plurality of electrodes, operatively connected between said terminals and disposed on the magnetic thin film, for coupling a microwave signal provided from the generating circuit to excite the magnetostatic wave in the magnetic thin film, wherein said plurality of electrodes are arranged at positions on the magnetic film where the microwave signal is not substantially coupled to excite the second to (n+1)th order modes of the magnetostatic wave, said electrodes being arranged to minimize the net total of the excitations for each of the second through the (n+1) order modes.

15. The device according to claim 14, wherein the bias magnetic field is applied perpendicularly to the surface where said thin film is disposed.

16. The device according to claim 14, wherein the bias magnetic field is applied in parallel with the surface where said thin film is disposed.

* * * * *